United States Patent [19]

Mohaupt et al.

[11] Patent Number: 4,917,659

[45] Date of Patent: Apr. 17, 1990

[54] PACKAGING CONTAINER EJECTION APPARATUS

[75] Inventors: John M. Mohaupt, Minneapolis; Mark R. Riemenschneider, St. Paul, both of Minn.

[73] Assignee: R. A. Jones & Co., Inc., Covington, Ky.

[21] Appl. No.: 40,906

[22] Filed: Apr. 21, 1987

[51] Int. Cl.[4] ..... B31B 1/78; B31B 1/04

[52] U.S. Cl. ..... 493/12; 53/53; 271/199; 271/302; 209/617; 209/925; 493/15; 493/16; 493/19; 493/125; 493/126; 493/181; 493/182; 493/316; 493/317

[58] Field of Search ..... 493/12, 15, 16, 19, 493/83, 125, 126, 181, 182, 316, 317; 53/53; 271/199, 302; 198/372; 209/617, 651, 652, 925

[56] References Cited

U.S. PATENT DOCUMENTS

| | | | |
|---|---|---|---|
| 3,519,119 | 7/1970 | Hershey | 198/372 |
| 4,053,056 | 10/1977 | Day | 53/53 |
| 4,064,675 | 12/1977 | Stapp et al. | 53/53 |
| 4,144,800 | 3/1979 | Hughes | 493/12 |
| 4,281,828 | 8/1981 | McDonald et al. | 493/12 |
| 4,348,853 | 9/1982 | Morse et al. | 493/316 |
| 4,349,998 | 9/1982 | Covert | 493/16 |

*Primary Examiner*—Frederick R. Schmidt
*Assistant Examiner*—Jack W. Lavinder
*Attorney, Agent, or Firm*—Wood, Herron & Evans

[57] ABSTRACT

Apparatus for removing defective knocked down carton blanks, from a carton erecting machine. In one embodiment opposed sets of tractors for clamping the selected unit and driving it from the conveyor line with moving tractive belts. A sensing device detects carton blanks to be ejected by determining if they can be erected by the machine. Non-conforming blanks are returned to an unerected condition and a control device activated by the sensing device controls activation of the ejecting mechanism to quickly and automatically eject the defective carton blank.

3 Claims, 6 Drawing Sheets

Fig. 1
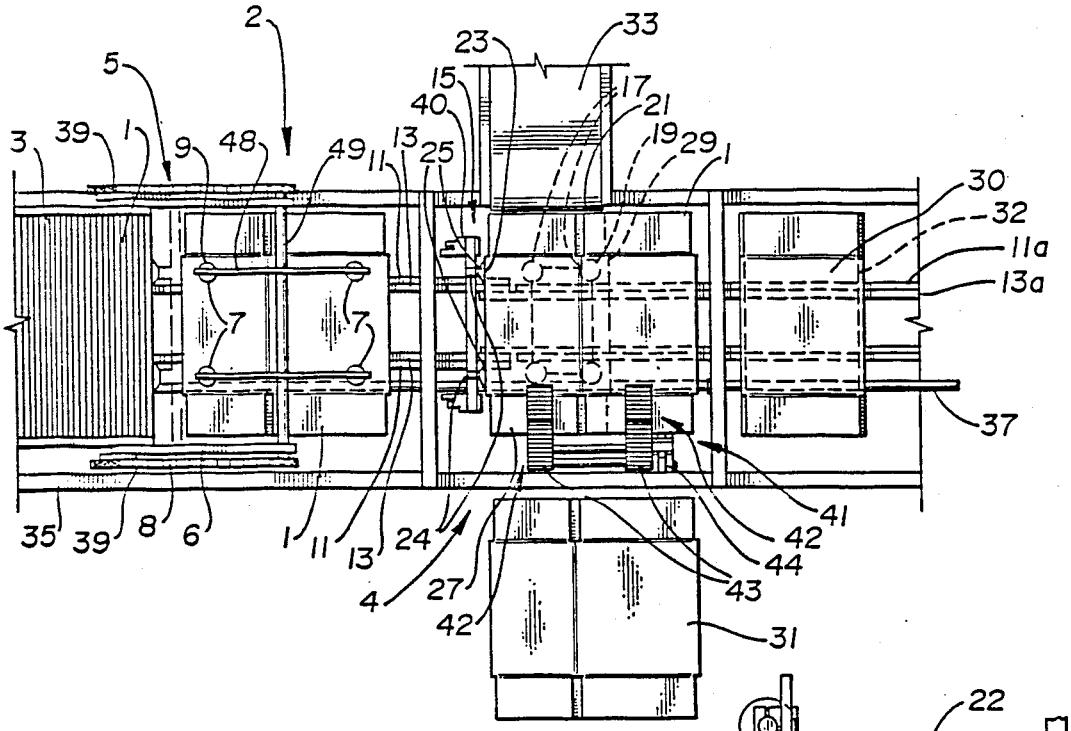
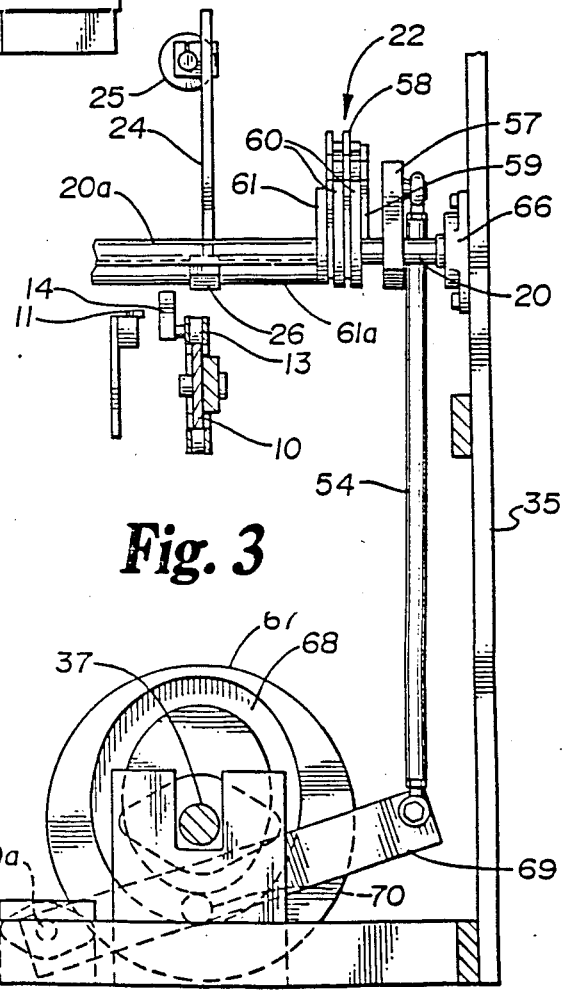
Fig. 3

PACKAGING CONTAINER EJECTION APPARATUS

BACKGROUND OF THE INVENTION

1. Description of the Prior Art

In many packaging machines flat, folded preformed cardboard containers are erected into cases or boxes which are then filled, closed, sealed and conveyed to a storage or further processing station. Occasionally, a blank will not erect because adhesive has extruded from the sealing seam to bond the panels to each other. At other times, a lack of sufficient adhesive, or a miscut in the cardboard, may result in a non-erectable blank. When any of these conditions occur, the machine must be shut down and the defective carton blank removed by hand. The resulting downtime and additional operator attention are costly. Furthermore, hand removal presents safety hazards to the operator, requiring shutdown of the machine each time a blank is to be removed.

2. Field of the Invention

This invention relates to machines for erecting cardboard box blanks. The invention most particularly relates to an apparatus for automatically ejecting non-erectable knocked down carton blanks from a carton erecting machine.

SUMMARY OF THE INVENTION

The present invention is an ejection apparatus for culling selected units of planar material from a conveyor line. The planar material may be flat cardboard carton blanks, lumber, sheets of thin material, or any object with planar surfaces which may be gripped by a tractor belt.

The invention comprises:

Apparatus for ejecting defective carton blanks from a carton erecting machine, comprising:

- conveyor means for transporting knocked down carton blanks to a carton erecting station and for transporting erected cartons from the carton erecting station along a transfer path;
- erecting means for erecting knocked down carton blanks at a carton erecting station;
- sensing means for determining whether a carton blank the carton erecting station fails to be properly erected by the erecting means and is therefore defective;
- ejecting means constructed and arranged when activated, for engaging defective carton blanks and ejecting them from the carton erecting machine; and
- control means actuated by said sensing means for actuating said ejecting means and for engaging defective carton blanks and ejecting them transversely to the transfer path of the erecting machine.

The ejection apparatus of this invention quickly ejects defective knocked down cartons from the machine without shutting it down. Hand removal of rejected objects is eliminated, resulting in a much safer and faster operation.

BRIEF DESCRIPTION OF THE DRAWINGS

The invention will be more easily understood by referring to the drawings, wherein like reference characters designate the or similar elements throughout the several drawings:

FIG. 1 is top view of a carton erection machine showing cartons at various stages of the operation and the upper elements of the invention.

FIG. 3 is a partial end view of the carton opener drive mechanism of FIG. 2, as taken along line 3—3.

DETAILED DESCRIPTION OF THE PREFERRED EMBODIMENT

Figure 2:
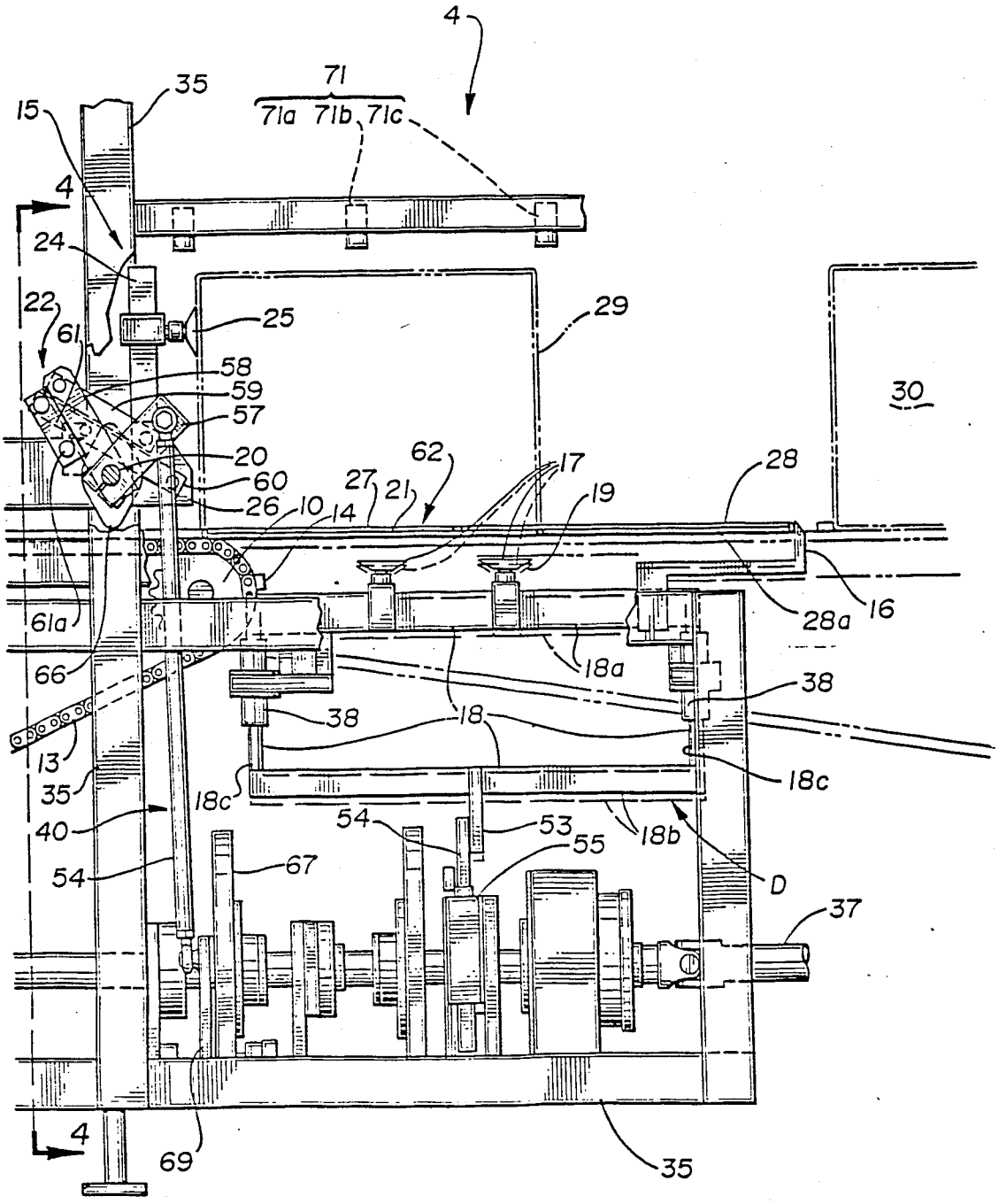
FIG. 2 is a fragmentary side elevation of the carton erecting station of the machine shown in FIG. 1.

Turning now to the drawings, a preferred embodiment of the present invention is illustrated as applied to a carton erecting and loading machine, from which the ejection apparatus detects and ejects defective cartons, that is, cartons which do not properly erect. The erecting and filling machine 2 is intermittently cycled for erecting and filling paper or cardboard cartons one at a time. FIG. 1 is a general plan view of the erecting portion 2 of an erecting and glueing machine showing some of the elements of the ejection apparatus of the invention in the carton erection zone 4 of machine 2.

Knocked down cardboard blanks 1 are fed from a magazine 3 which holds a supply of vertical blanks in reserve. A pick-and-swingdown carton handler 5 with an attached set 7 of case feed suction cups 9 lifts each successive carton blank 1 from magazine 3 and drops it onto slidetrack 11. A set of conveyor chains 13 moves the carton blank 1 to a carton erecting assembly 15 in erecting zone 4. A set 17 of base suction cups 19 holds a first panel 21 of the blank 1 while a set 23 of carton opening suction cups 25 lifts and swings a hinged second panel 27 of the blank to a right angle with the first panel, unfolding the carton blank 1 into an erected carton 29.

A product 32 may then be side-loaded into the erected carton 29 from product loading conveyor 33, and the loaded carton 30 is transported from carton erection zone 4 by conveyor chain **13*a*** to a carton closer which is not depicted.

Likewise, as shown in FIG. 2, set 23 of carton opening cups 25 is swung by drive shaft 37 acting through erection drive linkage 40 to unfold and open the knocked down carton blank 1 to an erected position. For the sake of simplicity, each cycle of the pick and swingdown apparatus 5 and of the carton erecting assembly 15 is shown as corresponding to one complete revolution of drive shaft 37. Coordination of the operations of the picking apparatus 5 and the erecting apparatus 4 as described thus far results in a system for rapidly and efficiently erecting and filling cardboard cartons.

Occasionally, a carton blank 1 will not open properly because of improper bonding of adjacent panels or for other reasons. In some cases, excessive glue or misplacement of glue bonds the inner faces of opposing panels together, preventing proper erection of the carton. In other cases, panels which are to be bonded together at their edges are inadequately glued, and the carton falls apart. Such defective carton blanks must then be removed from the erection and filling machine 2.

One embodiment of the ejection apparatus 41 of the present invention is shown in erection zone 4, at one side of slide track 11*a* and generally opposite the product loading conveyor 33. It is of course also possible, without departing from our invention, to locate the ejection apparatus outside of the erection zone at any convenient location downstream along the case transfer path.

In the embodiment shown, two upper ejection tractors or conveyors 42 with continuous flexible belts or tracks 43 mounted thereon are shown in an opened position, that is, in a position where they will not contact carton blanks during normal erecting and filling operations. A pivot drive means 44 comprising a pneumatic or hydraulic cylinder is connected to the set of upper ejection tractors 42 for moving it rapidly between an upper, unengaged opened position and a lower, closed or engaged position, where the upper ejection tractor belts 43 tractively contact the upper surface of the defective carton blank 31 and propel it transversely from the normal case transfer path to thereby eject it from the machine 2.

A conveyor chain 13 with attached pawl 14 is shown as comprising a moving horizontal means to support and transport flat carton blanks 1 from the carton blank picker handler 5 to the carton erection zone 4. The chain 13 passes around end sprocket 10 and is driven by a conveyor chain motor, not shown, through a conventional drive sprocket 36.

Magazine 3 is adapted to hold glued and folded carton blanks 1 in a vertical plane for picking by the pick-and-swingdown carton handler 5. The latter is shown, in FIG. 1, in a lower "drop" position B, where the picked blank 1 is being dropped onto the slidetrack 11 by releasing the vacuum in the suction cups 9.

FIG. 2 shows a flat carton blank 1 which has been transported to erection zone 4, where it is halted by a front stop 16. A set 17 of base suction cups 19 is mounted on suction cup frame 18 which is vertically movable between a lower position D as shown, and an upper position. The upper and lower frame members 18*a* and 18*b* are connected by rods 18*c* which pass through linear bearings 38, and together form cup frame 18. In the upper position of frame 18, suction cups 19 contact a lower or first panel 21 of the blank and hold it in place with vacuum during the carton opening and filling operations. The front stop 16 is connected to cup frame 18 to move up and down therewith. When the loaded erected carton 30 is released by the lowering of frame 18 and release of the vacuum in cups 19, downward movement of the stop 16 permits the carton to exit from the erection zone 4. A connecting link 53 is attached to cup frame 18, and is movably connected to cam follower 54. Follower 54 is slidably connected to cam 55 which is attached to and rotatively driven by drive shaft 37 to motivate cup frame 18 and base cups 19 upward and downward.

The carton erecting machine 15, and particularly the linkage 40 by which it is driven, may be more particularly described by reference to both FIG. 2 and FIG. 3.

In FIG. 2 and FIG. 3, a carton opening cup 25 is shown attached to finger 24 of suction cup base 26. Several suction cup bases 26, each holding a cup 25 on a finger 24, may be used. The cup bases 26 are so mounted on central pivot shaft 20*a* that they travel in unison between the lower position and the higher position. FIG. 3 shows the central pivot shaft 20*a* connected through multi-lever linkage assembly 22 to erection pivot shaft 20, which is pivotably mounted in bearing 66 on frame 35. The opposite end of central pivot shaft 20*a* is likewise connected through a similar linkage assembly to the opposite end of pivot shaft 20 bearingly mounted on frame 35.

Infeed conveyor chain 13 with attached pawl or pawls 14 is shown in both FIG. 2 and FIG. 3, mounted on end sprocket 10. Pawl 14 extends above the level of slidetrack 11 to push the carton blank 1 into the erection zone 4.

The drive linkage 40 includes a cam 67 with an eccentric cam rut 68, which is mounted on, and rotated by, drive shaft 37. Lever arm 69 has one end mounted on pivot 69*a* on frame 35 and includes a cam follower 70 which travels in rut 68. Second connecting rod 54 is pivotably connected to one end of lever arm 69 and to a fourth bell crank 57 which is connected to pivot shaft 20 for pivoting it back and forth through an arc Lever linkage assembly 22 is shown as comprising a bell crank 58 fixedly attached to pivot shaft 20, to turn therewith. Two point link member 59 is pivotably connected to the outer end of bell crank 58 and to suction cup base 26. Three point link member 60 is pivotably connected to suction cup base 26 and to a two point connecting link 61. The latter is pivotably attached at its opposite end at pivot 61*a* to frame 35. Link member 60 and bell crank 58 are pivotably connected in an intermediate area of each. The linkage assembly 22 moves the finger or fingers 24 between a vertical upper position and a horizontal lower position where cups 25 contact upper second panel 27 near a transverse fold line 62. The cups 25 seize the upper surface of panel 27 by vacuum-created suction, and the set 23 of cups move upwardly in an arcuate path, pulling panel 27 to an upright position. Panels 21 and 27, and their opposing panels 28 and 28*a*, are unfolded to form the erect rectangular carton 29.

Figure 4:
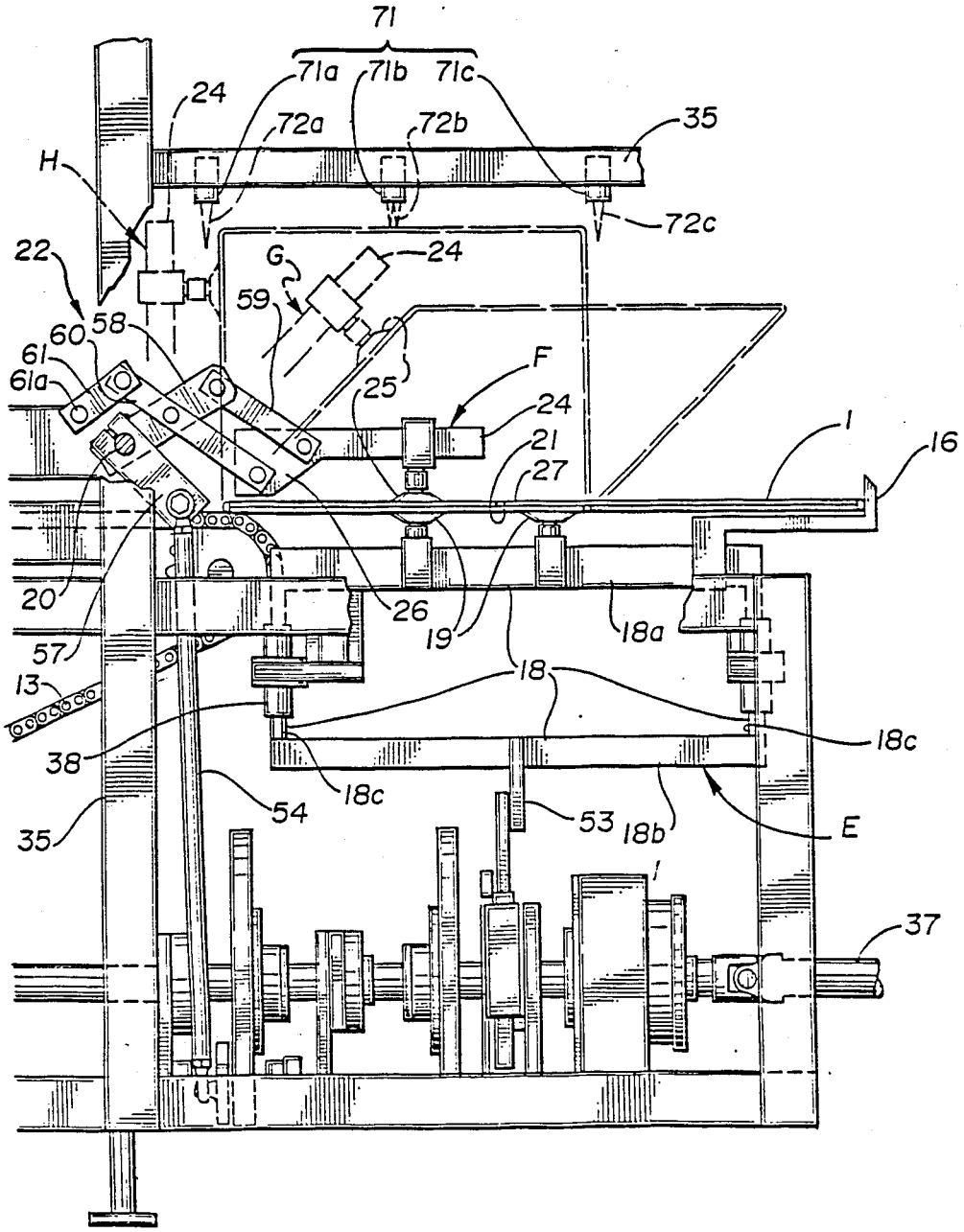
FIG. 4 is a fragmentary side elevation corresponding to FIG. 2, showing the opener and cartons in the unopened, partially opened, and fully opened positions.

Turning now to FIG. 4, this view is similar to that of FIG. 2 and shows the cup-bearing fingers 24 in a lower position F for suction attachment to the flat second panel 27 of the carton blank 1. Base suction cup frame 18, together with attached base cups 19 and front stop 16, is shown in an upper position E, to hold first panel 21 immobile during the unfolding operation.

In the lower position F, the multi-lever linkage assembly 22 extends base 26 with finger 24 over the flat carton 1.

Fingers 24 with opening cups 25 are also shown in an intermediate position G, where the carton is partially open, and in an upper position H to form the fully erected carton 29.

Following erection of the carton, cups 19 and 25 continue to hold the erected carton in place while product is being loaded therein. The vacuum is then released and cup frame 18 with attached front stop 16 is lowered to clear the carton transfer path. The filled carton 30 is moved by a discharge conveyor chain, not shown in FIG. 4, to a carton closure and discharge area, also not shown.

In the present invention, sensing means 71 detects defective carton blanks which are to be selectively removed from the packaging machine, and activates the ejection means. In FIG. 2, photosensors 71*a*, 71*b* and 71*c* are shown mounted on frame 35 above the erected carton 29. When the carton is in the desired fully erected position, middle photosensor 71*b* will detect the carton directly below, but rear photosensor 71*a* and front photosensor 71*c* will not detect the carton. This can be seen in FIG. 5, where light beam 72*b* of middle sensor 71*b* detects the fully open carton 29, while beams 72*a* and 72*c* do not detect the carton 29.

Alternatively, light beams from lamps, not shown, located below the slidetrack, may be aimed at sensing means 71. The presence of an object such as a carton between the lamp and its sensor cuts the beam to activate a sensor signal. Other detection or sensor means may be utilized, using well-known sensors based on sound, proximity or touch, i.e. tactile sensors, or other processes.

Figure 5:
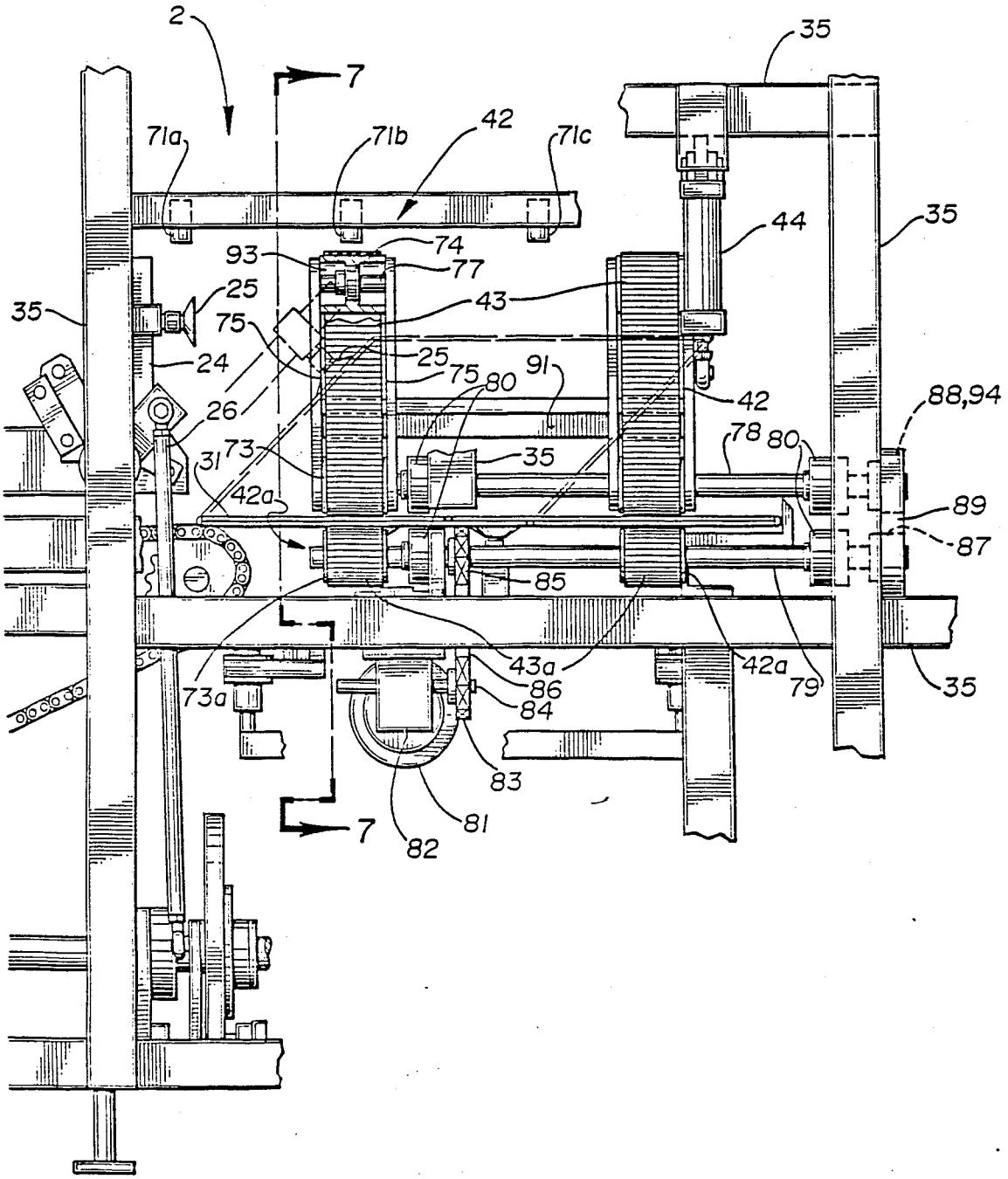
FIG. 5 is a fragmentary side elevation corresponding to FIG. 4, showing a preferred embodiment of the sheet material ejection apparatus of this invention superimposed over the opener and carton.
Figures 6, 7:
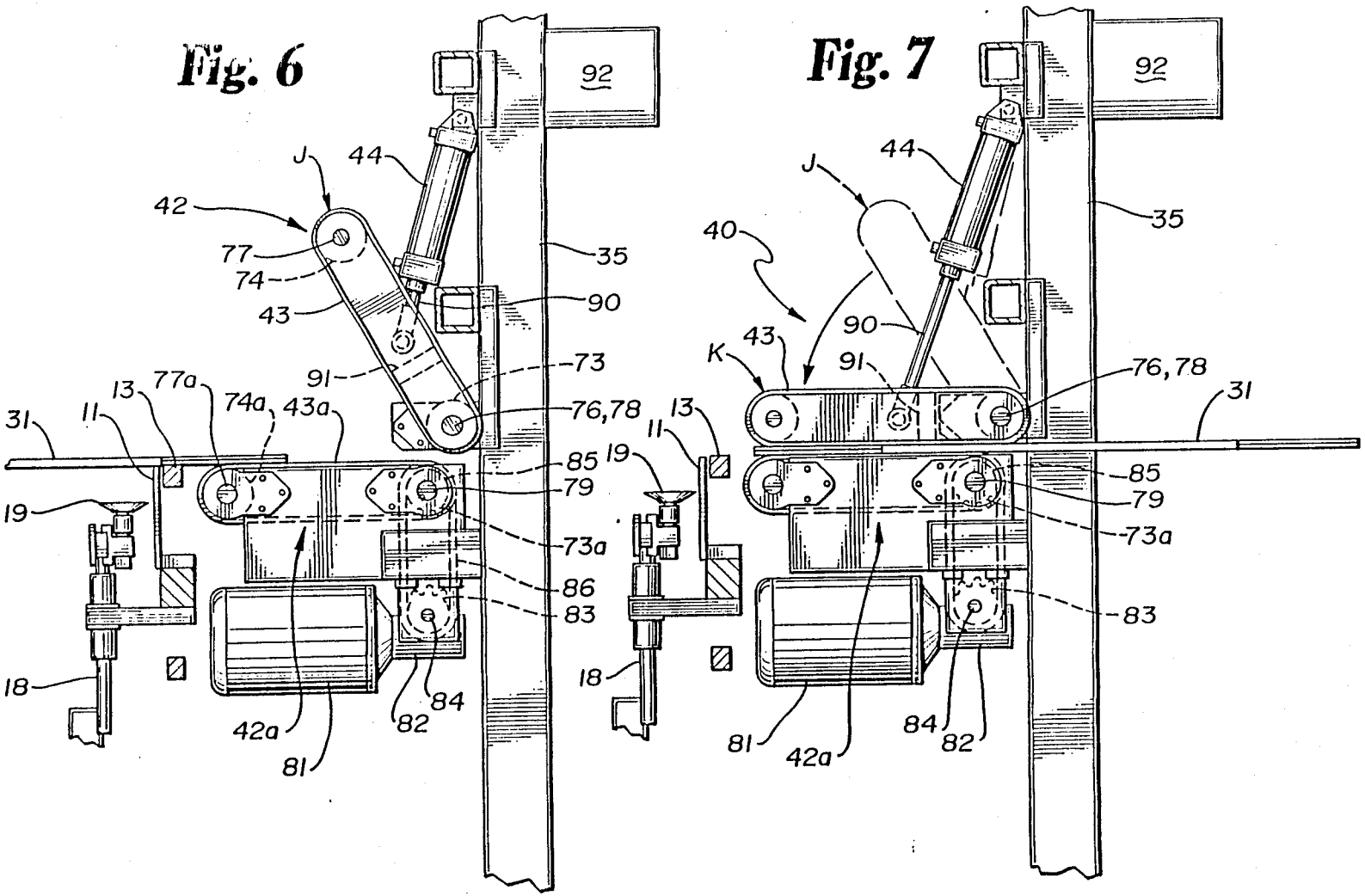
FIG. 6 is a sectional end view of the invention, taken along line 6—6 of FIG. 5, and showing a pivotable upper tractor in the normal, open position.
FIG. 7 is a sectional end view of the invention corresponding to FIG. 6, but showing the upper tractor pivoted to a closed position for ejecting a carton blank.

FIG. 5 is a view corresponding to FIGS. 2 and 4, showing the ejection apparatus 41 of the present invention in a normal open position prior to its activation for ejecting defective carton blank 31 from the carton erecting and filling machine 2. FIG. 6 is a different view of the ejection apparatus in the same position, indicated as "J", but showing the base suction cup 19 in a subsequent lowered position D. FIG. 7 shows the ejection apparatus with the tractors 42, 42*a* in a closed, clamped position K for rejecting the defective carton blank.

One embodiment of the defective knocked down blank ejects mechanism of the invention and the working thereof will thus be described in more detail while viewing FIGS. 5, 6 and 7 together. Two upper reject tractors 42 are shown in a near-vertical attitude or position J in FIGS. 5 and 6. In this position, the upper tractors do not interfere with the suction cup base or bases 26 with fingers 24 and carton opening cups 25, when they are in or near the lower position F. Two lower ejection tractors 42*a* are shown in a stationary horizontal position beneath the carton blank 1.

Each upper ejection tractor 42 includes a driven roller 73 mounted on and adapted to rotate with driven roller axle 76, and an idler roller 74 rotatably mounted on and adapted to rotate about idler roller axle 77. The bearings 93 may be roller bearings or ball bearings of standard design. The driven roller axle 76 and idler roller axle 77 are spacedly mounted at opposite ends of tractor body 75, which may be comprised of side panels in which axles 76 and 77 are rotatably mounted.

Each lower reject tractor 42*a* includes a driven roller 73*a* which is mounted on lower drive axle 79, and an idler roller 74*a* which is mounted on idler roller axle 77*a*. Axles 79 and 77*a* are affixed in a stationary position to frame 35.

A flexible continuous belt 43 made of rubber, leather, or other material with a suitable coefficient of friction, is mounted on each tractor 42, 42*a* to extend around each pair of driven roller and corresponding idler roller.

In the embodiment shown, the driven rollers 73, 73*a* and the idler rollers 74, 74*a* of the tractors comprise grooved pulleys, and the belts 43 have teeth on their inner, driven surfaces which engage the pulley grooves to provide a positive, non-slip belt drive. Such pulleys and positive-drive belts are well-known in the industry.

The driven roller axles 76 of the upper tractors 42 are coaxially connected to an upper drive axle 78, which rotatingly drives the roller axles 76 to move the belts 43 on the tractors. Likewise, the driven rollers 73*a* of the lower tractors 42*a* are driven by lower drive axle 79, to move the belts 43. The upper and lower drive axles 78 and 79, as well as lower idler roller axle 77*a*, are mounted in journals 80 attached to frame 35 to supportively maintain the proper axle location and alignment.

The means for driving the belts 43, 43*a* is shown as an electrical motor 81 with attached worm gear drive 82. Motor 81 is mounted on frame 35, and rotates a gearbox sprocket wheel 83 on gear shaft 84. A similar sprocket wheel 85 is mounted on lower drive axle 79, and sprocket wheels 83 and 85 are connected by tractor drive chain 86 for turning the lower tractor belts 43*a*. Upper drive axle 78 is shown, in FIG. 5 only, as being driven by lower belt sprocket wheel 87 on lower drive axle 79. A matching upper belt sprocket wheel 88 is mounted on a transfer gearbox 94, for transferring power to the upper drive axle 78. An endless transfer belt 89 is mounted on the two belt sprocket wheels so that both drive axles are rotated at the same speed but in opposite angular directions by motor 81, to eject the defective carton blank.

The upper ejection tractors 42 are connected by one or more support members 91 to join the upper tractors in a single rigid assembly which pivots about the axis of upper drive axle 78.

Cylinder 44 may be an air cylinder, i.e. pneumatic cylinder, and is shown mounted at one end to frame 35 and having a piston rod 90 extending therefrom and movably attached to one of the upper reject tractors 42. When the cylinder 44 is actuated, piston rod 90 is extended downward, as shown in FIG. 7, pivoting the upper tractors 42 downward so that the upper tractor belts 42 tractively contact the upper surface of the defective carton 31. At the same time, the lower tractor belts 42*a* tractively contact the lower surface of carton 31 and the defective carton is clamped between the upper and lower tractor belts. The belts are then driven by motor 81 to eject the defective carton blank 31 from the erection apparatus, as shown in FIG. 7.

Cylinder 44 is adapted to use pressurized fluid, for example air or hydraulic fluid, to position an internal piston with attached piston rod 90 passing through the cylinder. Cylinder 44 may be a double-acting fluid cylinder which alternately provides (a) a positive extension force through piston rod 90 to lower the upper tractor, and (b) a positive retraction force to raise the upper tractor to its open position.

Alternatively, cylinder 44 may be single-acting, using fluid pressure to lower the upper tractor, and spring means to subsequently raise the upper tractor. The spring, not shown, may be externally attached to the tractor, or may be within the cylinder itself. The alternative use of double-acting and single-acting cylinders such as described is well known in the art.

In order for the defective carton 31 to be ejected, it must be released from the grip of the suction cups 19 and 23. In practice, blanks which cannot be opened to erect release first from the erecting suction cups 25 which have a suction force which is intentionally set at a level below the suction force on cup 19. Thus, prior to downward pivoting of the upper tractor or tractors 42, suction vacuum is released from cups 19 and 25 and base suction cups 19 are lowered. The case blank then returns of its own weight to a substantially unerected configuration. Simultaneously, front stop 16, being connected to base suction cup frame 18, is also lowered, although this action is not necessary for enabling transverse ejection of the carton blank. The carton opening cups 25 will normally be in upper position E when the upper tractors are in the lowered, or clamped, position K for ejecting the defective carton blank.

Activation of the cylinder 44 and motor 81 is initiated and controlled by control means 92, based on (a) a signal from sensing means 71 and (b) which indicates the status of the carton erecting device 15. Control means 92 is preferably an electronic or electrical controller, but it may alternatively be a mechanical or pneumatic control device, for example. Many different control devices and algorithms may be used to control the operation of the ejection apparatus. In each case, sensing means 71 is required to determine which carton blanks are defective as evidenced by their failure to erect.

Figure 8:
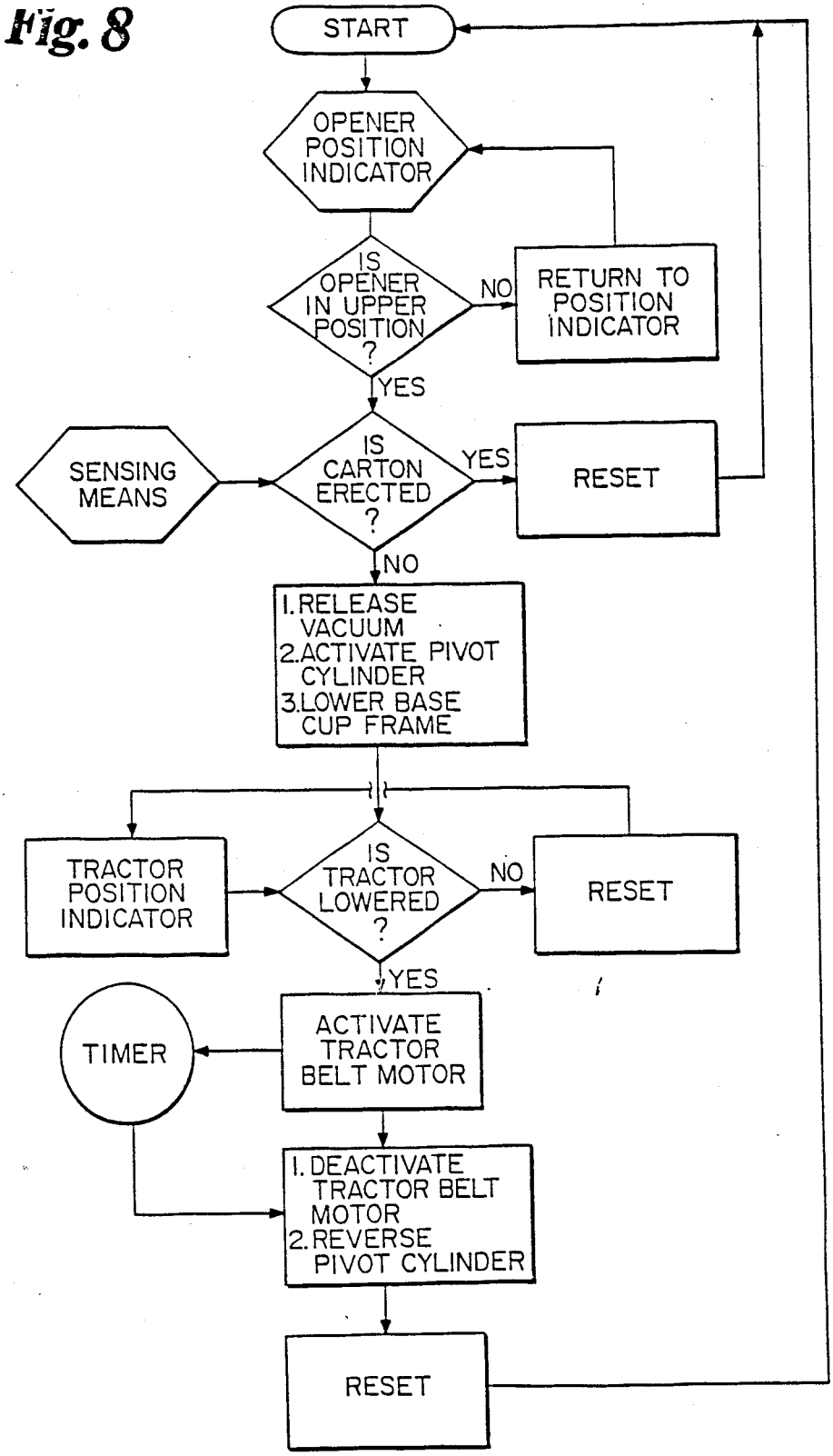
FIG. 8 is a simplified logic diagram of an exemplary control arrangement of the invention.

FIG. 8 shows one possible logic diagram which may be used as the basis for the controller used for ejecting non-openable carton blanks in a carton erection and filling line.

An opener position indicator indicates when the finger 24 and attached opening cups 25 are in an upper position, where the carton is normally opened and erect. Actuation of the ejection apparatus 41 is not permitted until the carton has had an opportunity to open and is then allowed to return to the unopened position. The opener position indicator may be activated by an indicator of the angular position of the drive shaft 37, a tactile switch or finger 24 or on another connected member, or other means.

A signal from sensing means 71 indicates whether the carton in the erection zone 4 has erected. If the carton is erect, the control means is reset for the next carton in line. If the carton has not become erect, the following actions are taken by the control means: (a) a valve controlling the vacuum to the opening cups 25 (if the cups have not already been pulled away from the carton when the carton failed to erect) and base suction cups 17 releases the vacuum from those cups, (b) the pivot cylinder 44 is activated to lower the pivotable tractor to the lower or clamping position, and (c) base cup frame 18 is lowered so that the defective carton blank 31 rests on the lower tractor belts 43*a*.

In this particular embodiment of the invention, it is desired to activate the tractor belts only after the pivotable tractor has fully descended to the lower or clamping position. A tractor position indicator is any means which indicates whether the tractor has been fully lowered, and may be a simple timer by which a proper time delay is effected. The tractor belt motor 81 which drives the upper tractor belts 43 and the lower tractor belts 43*a* is then activated for a timed period, to eject the defective carton blank 31. The belts are typically operated at a speed which results in fast ejection. For example, the belts may be run for less than one second. The belt timer then (a) deactivates the tractor belt motor 81, (b) reverses the action of the pivot cylinder 44 to raise the pivotable tractor 42 to the upper position, and (c) resets the control means 92.

The instant invention has been described herein as applied to a specific carton erection and filling machine. Its utility is not limited to such application, however. It may be used for other erecting machines without departure from the invention claimed. The ejecting structure can also be modified as indicated below.

FIGS. 5–7 show an ejecting mechanism where a pivotable belt idler is pivoted into engagement with the defective carton blank and a driven belt moves the blank out of the machine transversely to the normal carton transfer path. Alternatively, the eject mechanism can utilize a linear actuator 44 to cause the idler tractor 42 to extend and retract perpendicular to the face of carton blank 31 to engage it. Such a structure may work as well as the structure shown. It may also be desirable to provide for vertical movement of tractor 43*a* to engage the bottom surface of defective carton blanks.

Another alternative structure for the eject mechanism would be the substitution of belt driven wheels for the drive belt structure shown in FIGS. 5–7.

Rather than using eject mechanisms using driven conveyor belts or drive and idler wheels, it is of course also possible to utilize a set of jaws to engage a carton blank, retract it from the normal carton transfer path and deposit it in a scrap collecting area.

Any of the above ejection devices can be utilized with the machine. They can be positioned to engage the defective blank either in the erecting station after it fails to erect or at any convenient location downstream along the normal carton transfer path after leaving the erecting station.

Of course, the tractor alignment need not be limited to that which results in an ejection path normal to the production line. Thus, suitable tractors may be aligned at any angle transverse to the carton transfer path which provides the required clearance for ejection.

While the present invention has been particularly set forth in terms of specific embodiments thereof, it will be understood in view of the instant disclosure that numerous variations upon the invention are now enabled to those skilled in the art, which variations yet reside within the scope of the present teaching. Accordingly, this invention is to be broadly construed, and limited only by the scope and spirit of the claims now appended hereto.

What is claimed is:

1. Apparatus for ejecting defective carton blanks from a carton erecting machine, comprising:

conveyor means for transporting knocked down carton blanks to a carton erecting station and for transporting erected cartons from the carton erecting station along a transfer path;

erecting means for erecting knocked down carton blanks at a carton erecting station;

sensing means for determining whether a carton blank at the carton erecting station fails to be properly erected by the erecting means and is therefore defective;

ejecting means constructed and arranged when activated, for engaging defective carton blanks and ejecting them from the carton erecting machine, the ejecting means comprising:

upper means;

lower means;

the upper and lower means comprising first and second tractors at least one of which is pivotable from an open, non-contacting position to a closed, contacting position, at least one of which has a driven continuous belt for tractively contacting opposite sides of said carton blank;

actuator means for introducing relative movement between the upper means and the lower means when the ejecting means is actuated thereby to engage the top and bottom surfaces of a defective carton blank in the nip formed between the upper means and the lower means;

the actuator means comprises pivot means for pivoting at least one of said tractors from said open position to said closed position;

driving means for causing the upper means and the lower means to cooperate to eject the defective carton blank transversely to the carbon transfer path of the machine;

the driving means includes means for driving said continuous belt;

control means actuated by said sensing means for actuating said ejecting means and for engaging defective carton blanks and ejecting them transversely to the transfer path of the erecting machine;

the control means includes means for actuating the pivot means to pivot at least one of the tractors to a closed position and for activating the driving means to eject the defective knocked down carton blank from said erecting machine;

at least one of said tractors comprising:

a tractor body;

a driven roller mounted on an inner end of said tractor body and driven by a tractor drive shaft;

an idler roller rotatively mounted on an outer end of said tractor body;

said driven continuous belt of said tractor being mounted on said driven and idler rollers of the tractor, to travel thereon in response to said driven roller, wherein said tractor is pivotable about said tractor drive means;

2. The apparatus according to claim 1, wherein said drive and idler rollers of at least one of said tractors comprises pulleys with axially-directed grooves thereon, and said driven continuous belt has teeth on its inner surface for engaging said grooves for being positively driven thereby.

3. Apparatus for ejecting defective carton blanks from a carton erecting machine, comprising:

conveyor means for transporting knocked down carton blanks to a carton erecting station and for transporting erected carton s from the carton erecting station along a transfer path;

erecting means for erecting knocked down carton blanks at a carton erecting station;

sensing means for determining whether a carton blank at the carbon erecting station fails to be properly erected by the erecting means and is therefore defective;

ejecting means constructed and arranged when activated, for engaging defective carton blanks and ejecting them from the carton erecting machine, the ejecting means comprising:

upper means;

lower means;

the upper and lower means comprising first and second tractors, at least one of which is pivotable from an open, non-contacting position to a closed, contacting position, at least one of which has a driven continuous belt for tractively contacting opposite sides of said carton blank;

actuator means for introducing relative movement between the upper means and the lower means when the ejecting means is actuated thereby to engage the top and bottom surfaces of a defective carton blank in the nip formed between the upper means and the lower means;

the actuator means comprises pivot means for pivoting at least one of said tractors from said open position to said closed position;

driving means for causing the upper means and the lower means to cooperate to eject the defective carton blank transversely to the carton transfer path of the machine;

the driving means includes means for driving said continuous belt;

control means actuated by said sensing means for actuating said ejecting means and for engaging defective carton blanks and ejecting them transversely to the transfer path of the erecting machine;

the control means includes means for actuating the pivot means to pivot at least one of the tractors to a closed position and for activating the driving means to eject the defective knocked down carton blank from said erecting machine, at least one of said tractors comprising:

a driven roller mounted on a tractor drive shaft to be driven thereby;

an idler roller spaced from said driven roller; and said driven continuous belt of said tractor is mounted on said driven and idler rollers of the tractor to travel thereon;

one of said tractors being pivotable from an open, non-contacting position to a closed, clamping position for tractively contacting one side of said defective knocked down carton blank.

* * * * *